US006059137A

United States Patent [19]

Westwood et al.

[11] Patent Number: 6,059,137

[45] Date of Patent: May 9, 2000

[54] RECLOSABLE DRINK CAN

[76] Inventors: Peter L. Westwood, 520 Hayward Crescent, Milton, Ontario, Canada, L9T 4P9; Peter J. Knott, 13 Plantagenet Park, Yeovil, Somerset, United Kingdom, BA20 2RN

[21] Appl. No.: 09/101,784

[22] PCT Filed: Jan. 24, 1997

[86] PCT No.: PCT/CA97/00050

§ 371 Date: Dec. 17, 1998

§ 102(e) Date: Dec. 17, 1998

[87] PCT Pub. No.: WO97/27117

PCT Pub. Date: Jul. 31, 1997

[51] Int. Cl.[7] ..... B65D 41/32

[52] U.S. Cl. ..... 220/258; 220/269; 220/906

[58] Field of Search ..... 220/258, 269, 220/270, 906, 833–835, 787, 784, 789–791, 802–804, 268, 254, 256

[56] References Cited

U.S. PATENT DOCUMENTS

| | | | |
|---|---|---|---|
| 3,438,542 | 4/1969 | Feld . | |
| 3,981,411 | 9/1976 | Hofstetter | 220/268 X |
| 4,442,950 | 4/1984 | Wilson . | |
| 4,463,866 | 8/1984 | Mandel . | |
| 4,720,022 | 1/1988 | Gomes | 220/269 |
| 4,887,712 | 12/1989 | Wells | 220/269 |
| 4,979,635 | 12/1990 | Levine . | |
| 5,080,249 | 1/1992 | Shock | 220/269 |
| 5,555,993 | 9/1996 | Borkowski et al. | 220/269 |
| 5,779,087 | 7/1998 | Sharpe et al. | 220/269 |

FOREIGN PATENT DOCUMENTS

| | | |
|---|---|---|
| 8911288 | 11/1989 | Germany . |
| 9403674 | 5/1994 | Germany . |

*Primary Examiner*—Nathan J. Newhouse
*Attorney, Agent, or Firm*—Arne I. Fors

[57] ABSTRACT

A reclosable ring-pull opener (20) for a can (22) has a grippable ring (28). A closure (32) underlies the ring and extends above the top wall in parallel overlying relation to the top wall. The closure has a peipheral flange (34) and a downwardly depending skirt (37). A connecting nose (54) extends in folded, connecting relation from a peripheral edge (56) of the ring to an underlying peripheral edge (58) of the closure. A rivet (44) passes through the closure to movably mount the main body (27) on the top wall (26) of the can for upwardly directed, hinging movement of the ring toward the vertical, and for downward movement of the nose into opening urging contact with a scored, region (38), thereby to open the can. The rivet also mounts the main body atop the can for rotatable movement in the plane of the top wall to a position whereat the skirt overlies the opening, and for downwardly directed, movement of the closure, thereby releasably sealing the can.

4 Claims, 8 Drawing Sheets

RECLOSABLE DRINK CAN

This application is the national phase of international application PCT/CA97/00050 filed Jan. 24, 1997 which was designated the U.S.

This invention relates to containers, and in particular to cans having a ring-pull opener, as defined hereinafter.

Metal cans, made principally either of steel or aluminum, frequently are provided with so-called ring-pull openers, especially when the cans are intended to contain beverages. A ring-pull opener is normally provided in an end wall of a can, and has a manually-grippable ring member connected to the end wall by means of a rivet, often formed integrally with the end wall of the can. A removable area of the end wall is circumscribed by a score-line extending part-way through the thickness of the material of the end wall, and the arrangement is such that the material of the end wall bound by the score-line may be removed by manipulating the ring member, so as to open the can. Such an arrangement is referred to herein as a ring-pull opener of the kind described.

In an early ring-pull opener of the kind described, the ring member may be connected to the material of the end wall within the area bound by said score-line (the removable material). In this case, lifting of and pulling on the ring member breaks the removable material away from the remainder of the end wall along the score-line, so opening the end wall. This arrangement results in the ring member, together with the removable material being separated from the can, once opened. People have tended to discard the ring member and removable material somewhat inconsiderately, and so an alternative subsequent design of ring-pull opener has been developed especially for drinks cans, in which the ring member is secured to the non-removable material of the end wall, adjacent the score-line defining the removable material. In this design, the ring member includes a peripheral lever portion which projects beyond the fixing of the ring member to the end wall and overlies a part of the removable material; on lifting the ring member, the peripheral lever portion is pressed downwardly into engagement with the removable material and breaks that material away from the end wall, at least for the greater part of the length of the score-line. However, it is found that by breaking away the removable material in this way, it tends to remain connected to the end wall along one edge, and hinges down into the can about that edge—and this may be assured by reducing the depth of score where the removable material is required to hinge.

Though the early designs of ring-pull opener had ring members of true ring-shape, many common designs now employ ring members which can barely be regarded as ring-shaped. Nevertheless, the term "ring member" is used herein to refer to that member which is manipulated to open the can, irrespective of the actual shape or configuration of that member.

Once a can having a ring-pull opener of the general kind described above has been opened, there is no particularly convenient way of protecting the contents against contamination, spillage or loss of carbonation, if any. Thus, a need has long existed for a selectively reclosable ring-pull opener for use with drink cans, particularly for use with carbonated beverages. The recent trend toward larger can volumes for beverages, most notably for beer, has exacerbated this need. While there have been various proposals for plastics or rubber material caps or stoppers which may be pressed into the opening defined on removing the removable material of a beverage can, none have met with widespread commercial success. This may be due, in some part, to the fact that many of these prior art reclosable proposals result in a cap or stopper that will fit essentially only one shape and size of opening—and a very wide variety of shapes and sizes of openings are to be found in the market place.

More likely, however, is the fact that most prior art designs for reclosable ring-pull openers are impractical from a production point of view. This impracticality stems from two principle factors: cost and complexity. In the first instance, the beverage can industry is extremely cost sensitive. This is not surprising when it is considered that the annual world production of metal beverage cans with ring-pull openings exceeds two-hundred and twenty two (222) billion units, and the annual North American production of metal beverage cans fitted with ring-pull openers exceeds one-hundred and ten (110) billion units. With numbers this large, a cost increase in a beverage can or closure as small as 0.025 cent per unit (ie., $0.00025) results in an annual cost increase to the industry of many millions of dollars. This is especially critical in the soft-drinks beverage industry, where ever-increasing cost competition amongst the several largest beverage suppliers has made the industry extremely cost-sensitive.

With respect to the aforementioned issues of design complexity, it will be appreciated, that, in order to obtain the high annual production volumes previously mentioned, can manufacturers, of which a handful dominate the North American market, must run high speed production lines. In fact, modern metal can production lines, using the latest triple strip progression dies, produce ring-pull openers, for subsequent attachment to the can ends, at the rate of approximately three-hundred and thirty (330) ring pull openers per second. It will be readily appreciated that any significant increase in the number of parts, number of folds, amount of material folded, or other variables, may significantly increase the plurality of stations needed in the progression dies utilized in the production of the specific ring-pull openers, with a consequential increase in die cost, but, more importantly, in the production time for a single ring-pull opener. When these times are multiplied by the production rates specified above, and keeping in mind that these dies typically run 24 hours a day, 365 days a year (with the exception of down-time for repair and maintenance), it will be appreciated that a fraction of a second increase in production time for a single ring-pull opener can result in an annual reduction of millions of ring-pull openers per progression die. Moreover, it will be appreciated that, in order to reduce change over tooling costs, the progression dies to be utilized in the production of improved ring-pull openers for beverage cans and the like must be readily adaptable for use with existing high speed stamping presses and equipment without extensive modification. Similarly, the introduction of additional or complex parts into improved ring-pull openers has been and will continue to be resisted by the beverage can industry, as the additional material costs and production times will adversely impact upon bottom-line production values and profits.

The end result of the above factors is that the beverage can industry has not been able to develop a selectively reclosable ring-pull opener for use with metal drink cans that meets the rigid economic and performance criteria of that industry. Accordingly, the same basic un-reclosable ring-pull openers have continued to be used for approximately two decades in association with the tens of billions of cans produced annually by beverage can manufactures, despite the on-going need for a selectively reclosabel ring-pull opener for this purpose.

U.S. Pat. No. 4,979,635 issued Dec. 25, 1990 entitled "Easy Opened Can with Internal Reclosure Flap" discloses a beverage can having a closure flap for reclosing the opening found in the can lid. The closure flap may have a seal-echancing polymer coating the whole of the underside and a lightly biased peripheral skirt. Carbonated beverages under pressure cannot be effectively sealed, with resulting loss of carbbonation, and contents can be lost spillage upon upset of a can.

Accordingly, it is a pricipal aim of the present invention to provide a selectively reclosable ring-pull opener for use with a metal whereby the contents of the can may be protected against contamination, spilled or loss of carbonation, following opening of the can, but before the contents thereof have fully been consumed.

It is a further object of the present invention to provide a selectively reclosable ring-pull opener that can be produced in extremely high volumes.

It is yet another object of the present invention to provide a selectively reclosable ring-pull opener that can be produced using high speed progression dies that are readily adapted for use with existing high-speed stamping lines and equipment without significant modification to such lines or equipment.

It is yet another object of the present invention to provide a selectively reclosable ring-pull opener that can be produced from existing materials without the introduction of complex folding or stamping techniques that would significantly slow down the production rates attainable with prior art un-reclosable ring-pull openers.

According to the present invention, there is provided a novel and inventive structure of selectively reclosable ring-pull opener for use with a can of the type having a top wall, a base wall, and a cylindrical side wall joining said top and base walls together in sealed relation, with a score line in said top wall defining a movable region of material. The movable region of the top wall material is movable between a first closed position, whereat it is integral with the top wall in sealing relation therewith, and an open position whereat the movable region of material is displaced from the first closed position to create an opening in the top wall. The movable region of material is bounded by a non-movable region of material of the top wall. The ring-pull opener of the invention is characterized by a unitary main body comprising a manually grippable ring portion extending above said top wall in acutely angled relation to said top wall to define a first operative plane relative to said top wall, a closure portion underlying said manually grippable ring portion and extending above said top wall in substantially parallel overlying relation to said top wall to define a second operative plane substantially parallel to said top wall, with the closure portion having a peripheral flange portion and a downwardly depending skirt portion of substantially the same plan outline and size as said opening. The closure portion is solid at least within the area bounded by the skirt portion. A tab portion extends downwardly from the ring portion to contact, in overlying relation, an upper surface of the peripheral flange portion of the closure portion. A connecting nose portion extends in folded, connecting relation from a peripheral edge of the ring portion to an underlying peripheral edge of the closure portion. A mounting means, preferably in the form of a rivet, is affixed to the top wall and operatively passes through the tab portion and the upper surface area of the flange portion to movably mount the main body on the top wall of the can for upwardly directed, hinging movement of the manually grippable ring portion from the first operative plane toward the vertical, for coincident downward movement of the connecting nose portion into opening urging contact with the movable region of material of the top wall of the can, thereby to cause movement of the movable region from the first closed position to the open position, for rotatable movement of the main body in the second operative plane from a first position whereat the skirt portion is removed from overlying the perimeter of the opening, and a second position whereat the skirt portion is in overlying registered relation with the opening, and for downwardly directed, hinged movement of the closure portion below the second operative plane. The peripheral flange portion is preferably continuous, and is shaped and dimensioned to overlie the perimeter of the opening in overlapping contacting relation to the non-movable region of top wall material, when the movable region of material has been moved to the open position as aforesaid, the main body has been rotatably moved to the second position, and the closure portion has been hingingly moved as aforesaid below the second operative plane to a fully inserted position, at which fully inserted position the closure portion substantially occludes the can opening. The outer surface of the downwardly extending skirt portion is preferably provided with one or more laterally outwardly extending nibs adjacent the downward extent of the skirt portion, such that, when the skirt portion is, in the aforesaid fully inserted position, within the can opening, the nibs underlie the wall of the can and resist removal of the skirt portion from within the opening by way of yielding frictional contact with the wall of the can upon such removal. A bead or film of sealing material is preferably provided at the area of the junction between the skirt portion and the peripheral flange portion to enhance the sealing between the peripheral flange portion, the skirt portion and the opening.

It may be advantageous to provide a recess in the end wall of the can to accommodate the closure portion of the ring-pull opener, prior to the ring-pull opener being manipulated to open the can. In this way, the presence of the closure portion need not affect the disposition of the ring-pull opener closely adjacent the general plane of the end wall of the can prior to the opening thereof, and so the stack ability of the cans, one on another, will not be affected.

By way of example only, a preferred embodiment of this invention will now be described in detail, reference being made to the accompanying drawings, in which.

Figure 1:
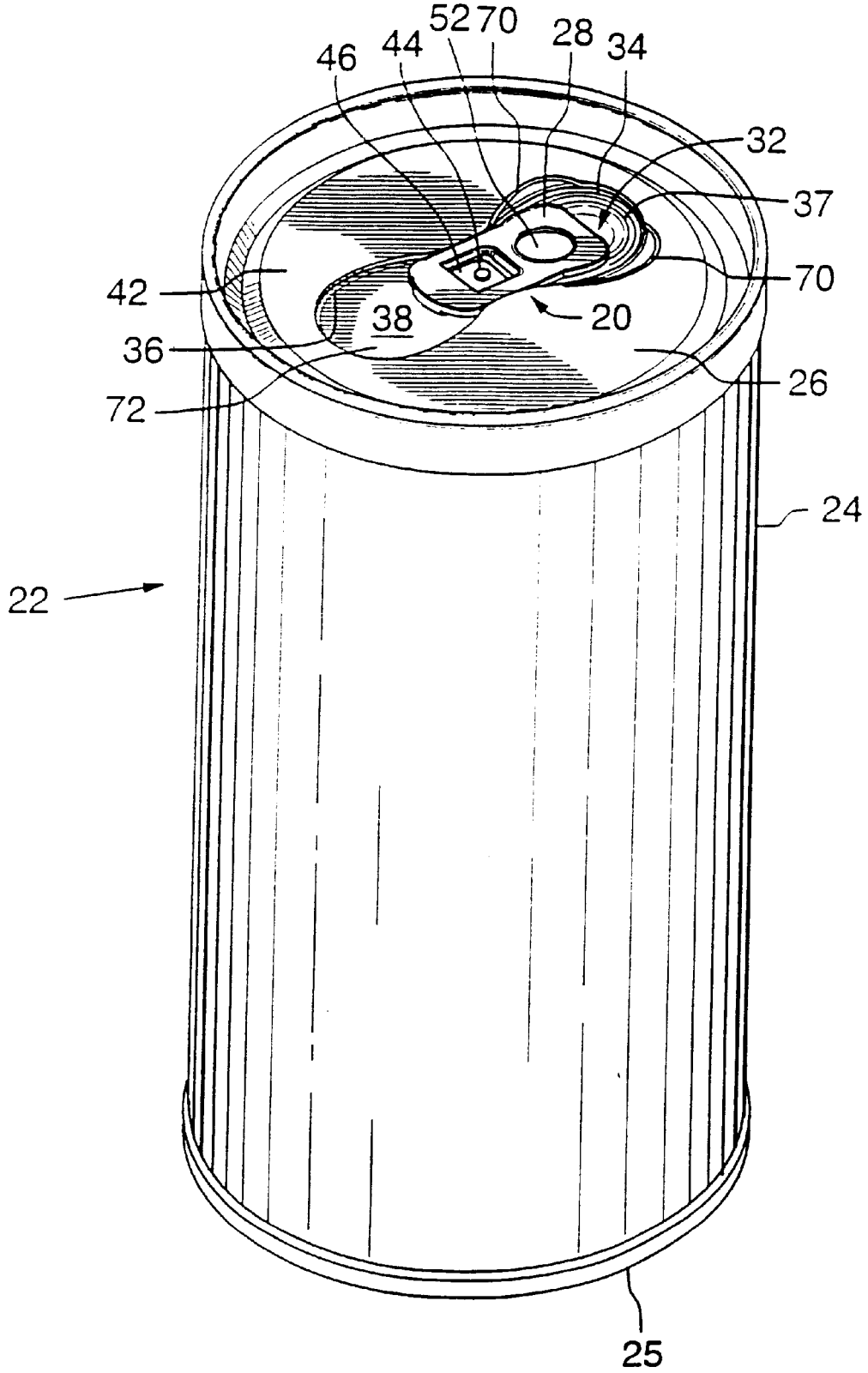
FIG. 1 is a perspective view of an unopened beverage can provided on its top wall with a ring-pull opener according to a preferred embodiment of the present invention having its main body shown in a first position.
Figure 2:
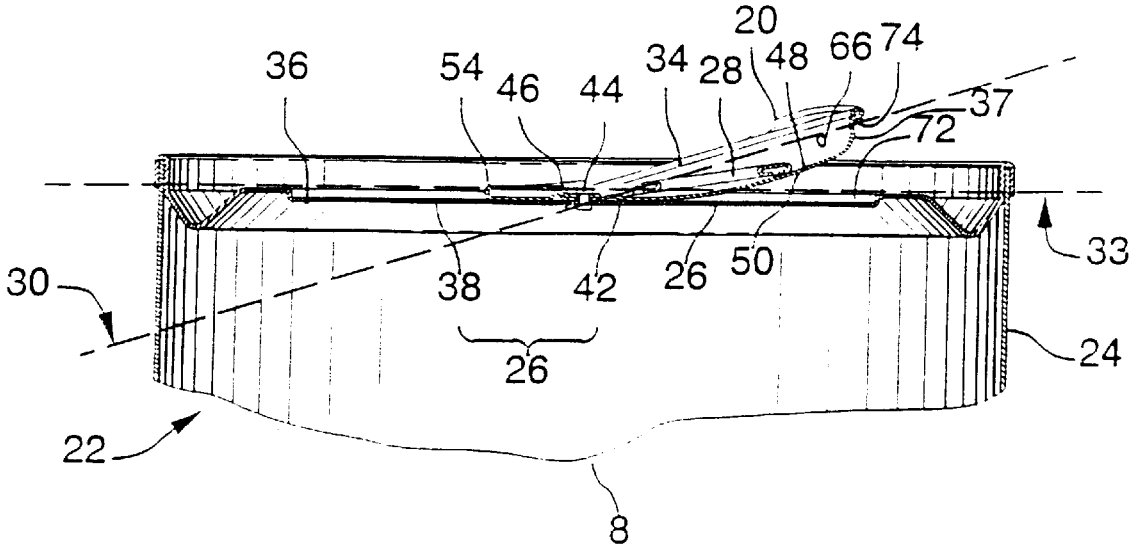
FIG. 2 is a sectional side elevational view of the top portion of the beverage can and ring-pull opener of FIG. 1.

A preferred embodiment of the present invention will now be described in association with FIGS. 1 through 9C. As seen in FIGS. 1, 2 and 3, a ring-pull opener 20 according to the present invention may be employed with a conventional metallic can 22, typically having a cylindrical side wall 24 and a base wall 25. The can 22 may be a beverage can, or, for example, a can used to hold non-consumable liquids, such as, for example, motor oil or additives therefor. Typically, the can will have a top wall 26 secured, for example, by conventional crimping, to the upper edge of the side wall 24. The top wall 26, the base wall 25, and the cylindrical side wall 24 are joined together in sealed relation so as to contain, for example a carbonated beverage. Such a drink can 22 may be made from relatively thin sheet steel or aluminum, appropriately treated, as is well known in the art, to prevent degradation or contamination of the contents.

A score line 36, being a line of weakness extending part-way through the thickness of the material of the top wall 26, is conventionally scribed on the top wall 26 of the can 22 to define a movable region of metal material 38 of the top wall 26, which region 38 is typically arcuate, and is displaceable from a first closed position (seen in FIGS. 1, 2 and 3B) whereat the movable region of material 38 is integral with the top wall 26 in sealing relation therewith, and an open position (seen in FIGS. 4A through 9C) whereat the movable region of material 38 is displaced from the first closed position, so as to create an opening 40 in the top wall 26, the movable region of material 38 being bounded by a non-movable region of material 42, which non-movable region of material 42 generally defines the remainder of the top wall 26. The contents of the beverage can 22 can be emptied by a user through the opening 40, once said opening is created, in the manner described hereinbelow.

The ring-pull opener 22 is connected to the top wall 26 of the beverage can 22 by a mounting means positioned on the top wall 26 so as to provide for moveable attachment of the ring-pull opener 22 in a manner that will be described more fully below. The mounting means is preferably a rivet 44 extending through apertures in both the top wall 26 and the ring-pull opener 22. Though in the drawings the rivet 44 is shown as a separate item, it is in fact possible to secure the ring-pull opener 22 to the top wall 26 by means of a rivet which is formed integrally with the material of the top wall 26, and which is deformed to hold the ring-pull member 22 in position, once fitted on to that rivet.

The ring-pull opener 20 includes and is characterized by a unitary main body 27, which is stamped from strip metal as it passes through a high speed progression die. The unitary main body 27 is shown unfolded in FIG. 3A, which main body 27 has a manually grippable ring portion 28 extending above the top wall 26 in acutely angled relation to the top wall 26 so as to define a first operative plane, designated by dashed line 30 of FIG. 2, relative to the top wall 26. The main body 27 further includes a closure portion 32 which, in the operative folded configurations shown in all but FIG. 3A of the drawings, underlies the manually grippable ring portion 28 and extends above the top wall 26 of the can 22 in substantially parallel overlying relation to the top wall 26, so as to define a second operative plane of motion substantially parallel to the top wall 26, which second operative plane is designated in FIG. 2 by a dashed line having the reference numeral 33. The closure portion 32 itself has a peripheral flange portion 34, which is preferably continuous, and a downwardly depending, preferably continuous, skirt portion 37 having substantially the same plan outline and size as the opening 40 of the can 22 so as to close fitted within the opening 40 as will become apparent as this description progresses. As best seen in FIG. 4B, the closure portion 32 essentially comprises the peripheral flange portion 34, the skirt portion 37 and an upper surface 49 of the closure member, which upper surface 48 is disposed at the lower most extent of the skirt portion 37, so as to define an embossment adapted to selectively occlude opening 40, as described more fully below. As seen in the sectional view of FIG. 4B, the embossment so formed by the elements 34, 37, and 48 of the closure portion 32 is preferably tapered in its depth, with the deepest section on the outer edge furthest from the rivet 44, and the shallowest section towards the rivet 44, such taper being non-linear. This arrangement allows the closure portion to be rotated about the rivet 44 and then pushed down into the opening 40 without "undercut" or other fouling conditions with the edge of the opening 40 arising.

Figure 3B:
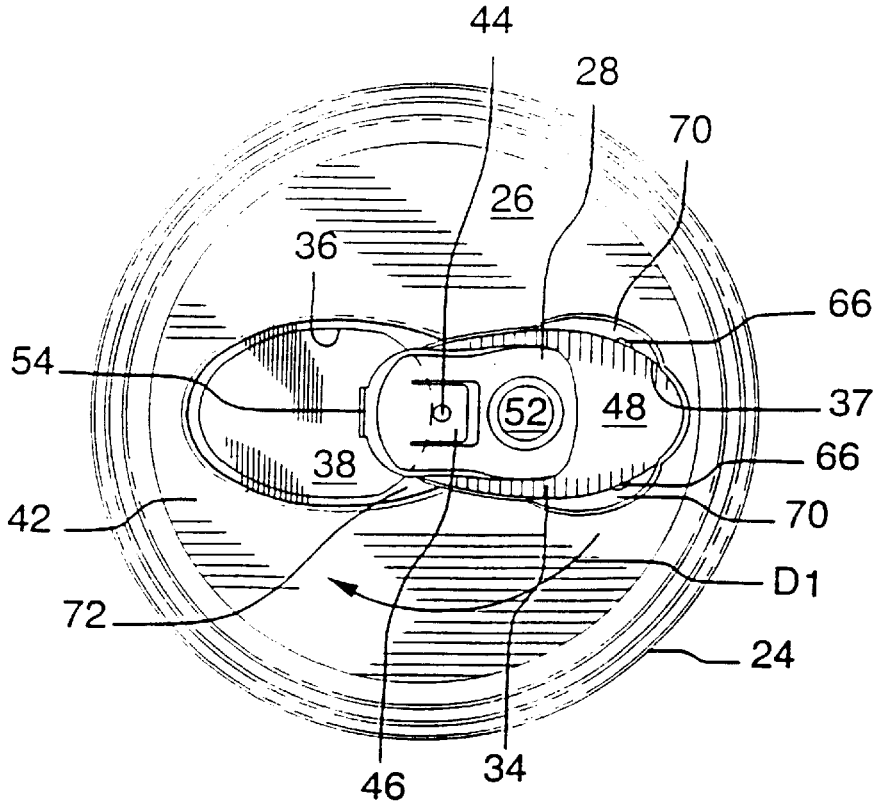
FIG. 3B is a top plan view of the ring-pull opener and beverage can of FIGS. 1 and 2.
Figure 3A:
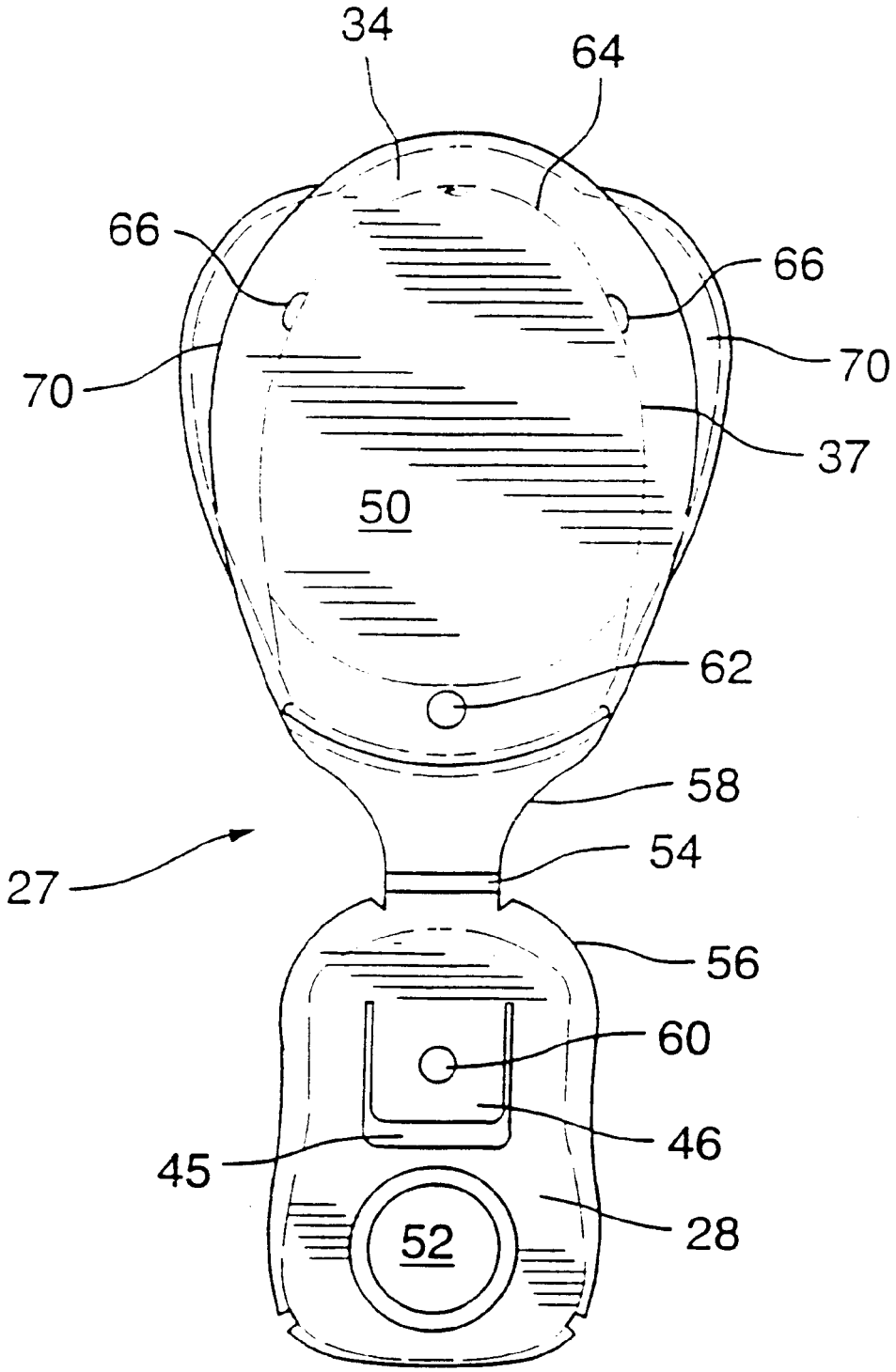
FIG. 3A is a bottom plan view of the main body of the ring-pull opener of FIGS. 1 and 2 prior to it be folded upon itself for final attachment to the top wall of the beverage can of FIGS. 1 and 2.

The main body 27 further comprises a tab portion 46, which is defined by a three-sided cut 45, and which, in the operatively folded configurations shown in all but FIG. 3A, extends downwardly (ie. toward the top wall 26 of the can 22) to contact, in overlying relation, an upper surface 48 of said closure portion 32, which upper surface 48 is bounded by the inner extent of the skirt portion 37. As will be appreciated from the Figures, the downwardly depending skirt portion 27 has substantially the same plan outline and size as the opening 40 in the top wall 26, such that the closure portion 32, including the upper surface 48, and a corresponding parallel lower surface area 50, which lower surface 48 is bounded by the outer extent of the skirt portion 37, cause the closure portion 32 to be solid in the area bounded by the skirt portion, so as to thereby occlude the opening 40 of the can 22 as will appreciated as this description proceeds.

The main body 27 further comprises a connecting nose portion 54, which nose potion 54 extends in folded connecting relation from a peripheral edged 56 of the ring portion 28 to an underlying peripheral edge 58 of the closure portion 32.

The manually grippable ring portion 28 is preferably in the shape of an elongated rectangle, with a circular cut-out 52 positioned for gripping by a user adjacent the end of the grippable ring portion 28 disposed distal to the rivet 44 , and with the tab portion 46 preferably extending downwardly toward the upper surface 48 as aforesaid from an opposite other end of the ring portion 28.

The movable region of material 38 is of the same general plan shape and size as the closure portion 32 (with the peripheral flange portion 34 excluded), and, with the main body 27 in its first position before opening of the can 22 (as illustrated in FIGS. 1, 2 and 3B), the axis of symmetry of the movable region of material 38 is on the same line as the axis of symmetry of the main body 27, but on the other side of the rivet 44. The connecting nose portion 54 thus partially overlies the movable region of material 38 defined by the score-line 36. The connecting nose portion 54 is shaped and dimensioned to urgingly contact the movable region of material 38 so as to displace the movable region of material 38 from the first closed position to the second open position, as aforesaid, upon manual manipulation by a user of the grippable ring portion 28 about the rivet 44 in a generally upward direction away from the top wall 26 (see arrow A1 of FIGS. 4A and 4B). The rivet 44 acts in this manner as a fulcrum to facilitate such manual manipulation.

Figure 4A:
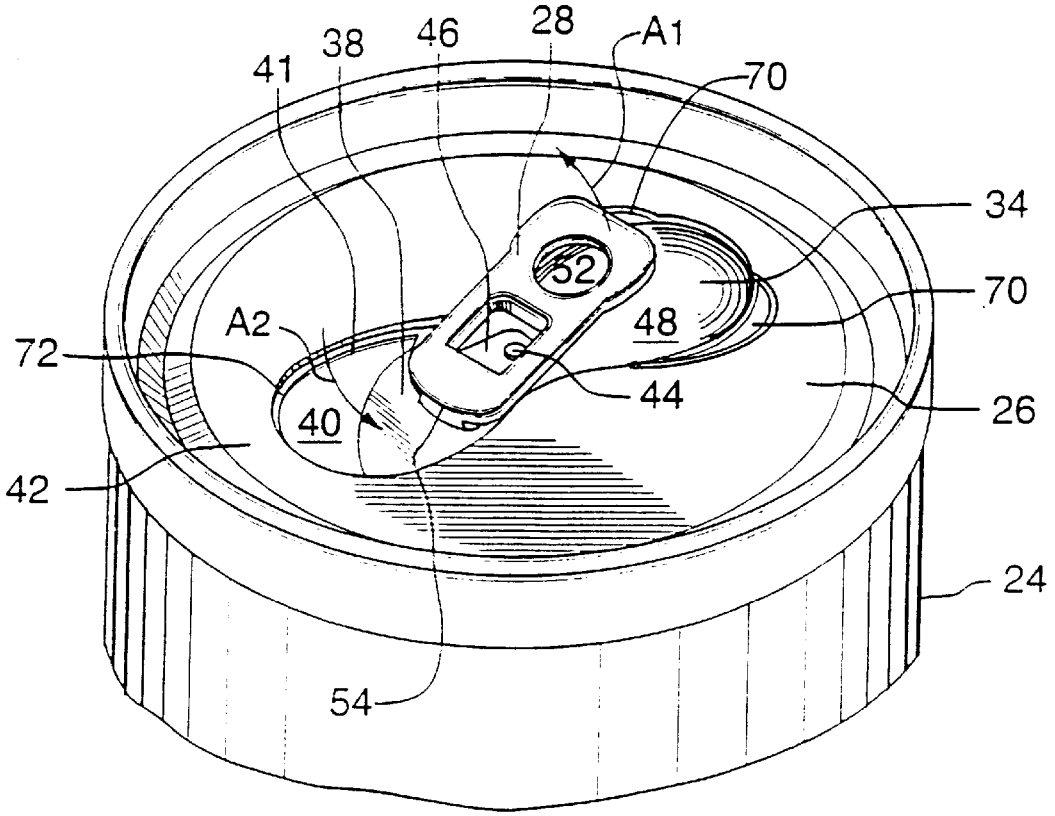
FIG. 4A is a perspective view similar to FIG. 1, wherein the ring portion of the ring-pull member has been manipulated upwardly so as to create an opening in the top wall of the beverage can.
Figure 4B:
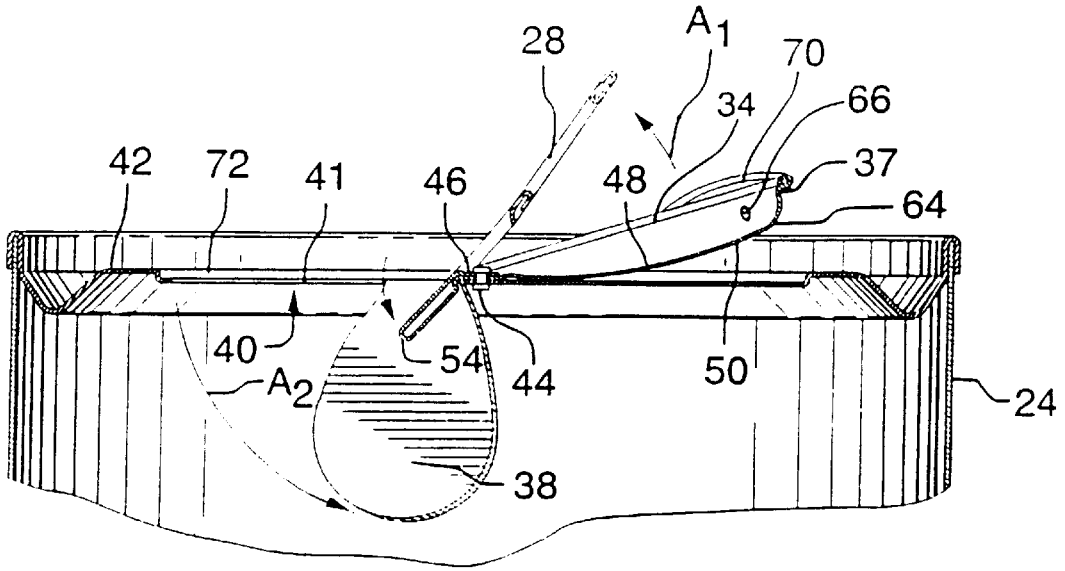
FIG. 4B is a sectional side elevational view of the beverage can and ring-pull opener of FIG. 4A.
Figure 5A:
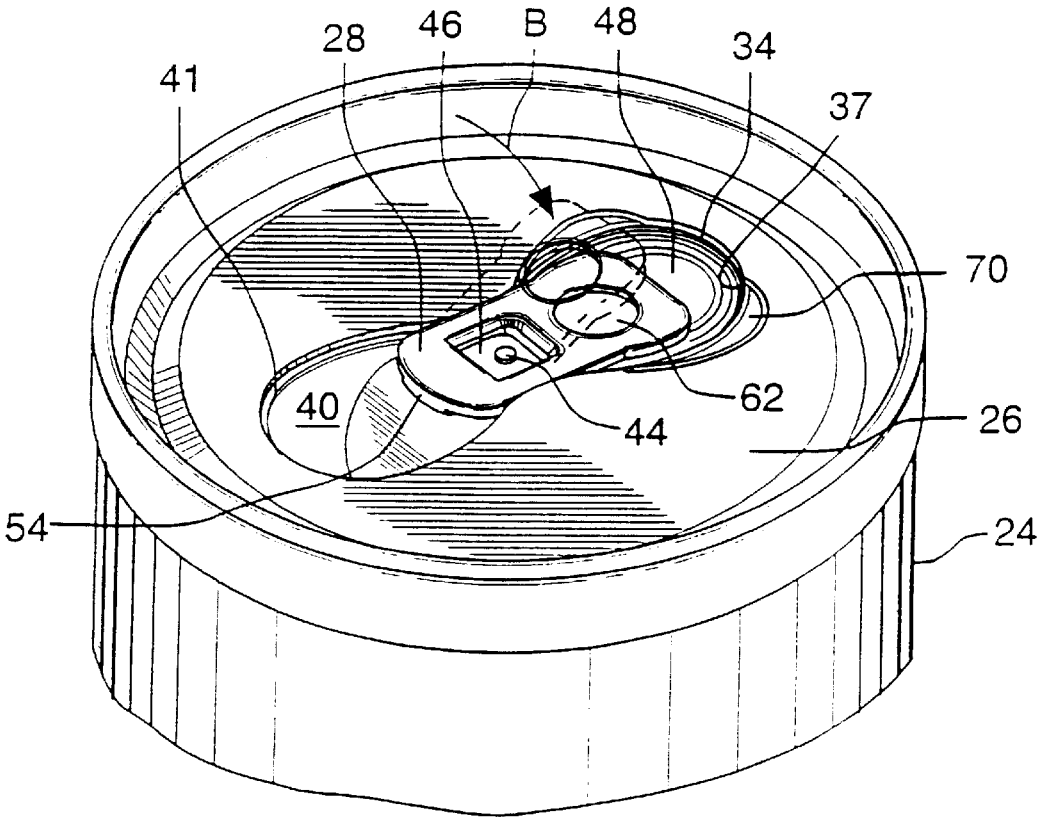
FIG. 5A is a perspective view similar to FIG. 4A, wherein the ring-pull member has been manipulated from the position of FIG. 4A (also shown in phantom outline in FIGS. 5A and 5B) downwardly so as cause said ring portion to re-assume its initial position.
Figure 5B:
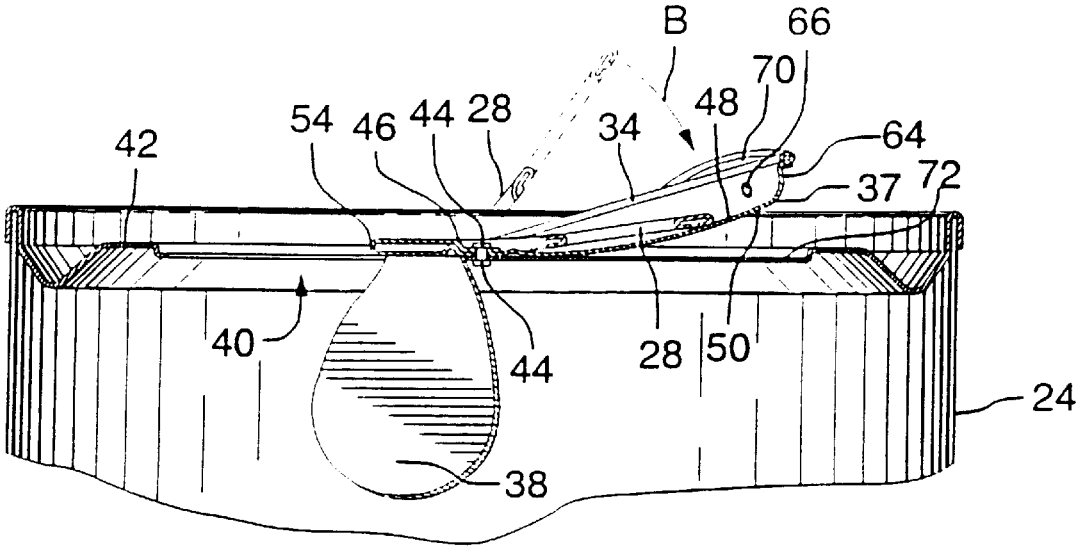
FIG. 5B is a sectional side elevational view of the beverage can portion and ring-pull opener of FIG. 5A.
Figure 6:
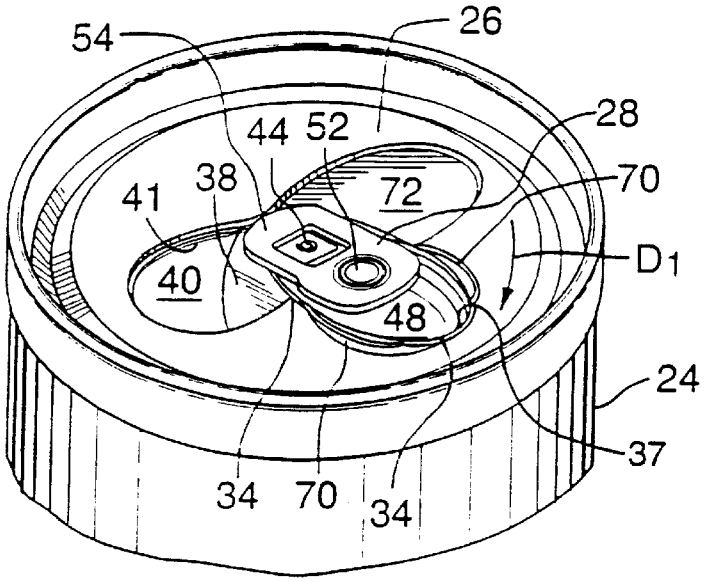
FIG. 6 is a view similar to FIG. 5A, wherein the ring-pull opener has been rotated in a clockwise direction approximately 90 degrees so as carry the main body from the first position of FIG. 5A to an intermediate position between said first position and a second position thereof shown in FIGS. 7A and 7B.

In order to open the can 22, the grippable ring portion 28 is lifted by a user gripping the circular cut-out 52, and thereafter moving the ring portion 28 in the direction of arrow A1 of FIGS. 4A and 4B. This action causes the connecting nose portion 54 to exert a downward pressure on the movable region of material 38, so shearing that region away from the remainder of the top wall 26, along the score line 36. The movable region of material 38 is thus moved inwardly of the can 22, as indicated by arrow A2 of FIGS. 4A and 4B, so opening it; but the movable region of material 38 normally hinges downwardly about one edge, as can be seen in FIGS. 4A. This may be assured by having a lesser depth of score toward the rivet side of edge 41.

The rivet 44 is affixed as aforesaid to the non-movable region 42 of the top wall 26 of the can 22, and operatively passes through an aperture 60 (see FIG. 3A) in the tab portion 46. The rivet 44 thereafter passes through an aligned, overfolded aperture 62 in the closure portion 32 to thereby movably mount the main body 27 on the top wall 26 of the can 22 for upwardly directed, hinged movement of the manually grippable ring portion 28 (as described in the previous paragraph) from the first operative plane 30 towards the vertical. This movement of the ring portion 28, in turn, causes coincident downward movement of the connecting nose portion 54, as previously described, into urging opening contact with the movable region of material 38, thereby causing movement of the movable region of material 38 from its closed position (shown in FIGS. 1, 2 and 3B) to its open position (shown in FIGS. 4A through 9C).

The attachment of the main body 27 by the rivet 44 in the manner shown also provides for rotatable movement of the main body 27 in the second operative plane 33 from a first position (corresponding to the position shown in FIGS. 1, 2, 3B and 4A through 5A) whereat the skirt portion 37 is removed from overlying the perimeter of the opening 40, to an intermediate position (corresponding to the position shown in FIG. 6), and thereafter to a second position (shown in FIGS. 7A and 7B) at which second position whereat the skirt portion 37 is in overlying registered relation with the opening 40. This progression of rotatable movement is indicated in the drawings by the sequence of arrows D1 and D2 in FIGS. 3B, 6 and 7A. After opening the can as previously described, but prior to moving the main body 27 from the first position of FIGS. 5A and 5B, it is desirable to move the grippable ring portion 28 from its raised position (shown in FIG. 4B and in phantom outline in FIG. 5A) in the direction of arrow B of FIGS. 5A and 5B, to a lowered position, as shown in solid outline in FIG. 5B), thereby to ensure that the connecting nose portion 54 is sufficiently withdrawn upwardly from the opening 40 so as not to be impeded from such rotation by contact of the connecting nose portion 54 with the edge 41 of the opening 40, or with the movable portion 38.

Figure 7A:
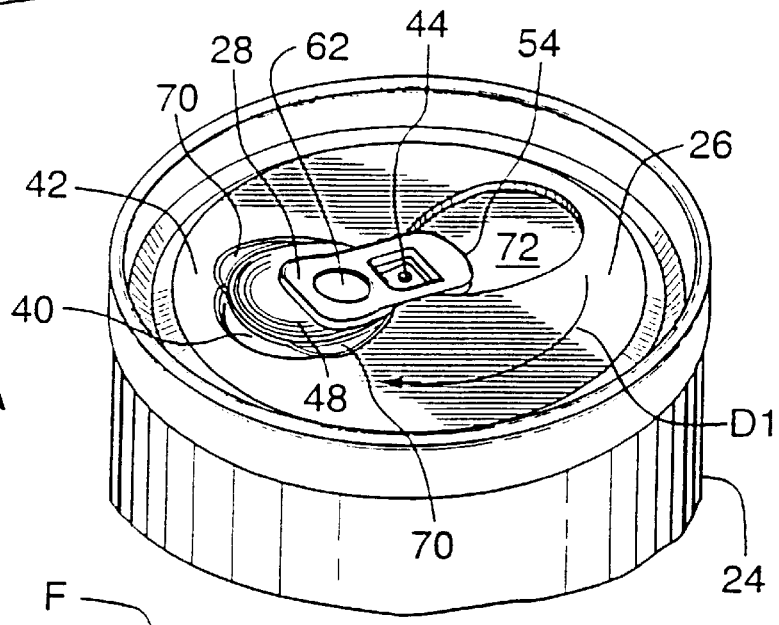
FIG. 7A is a view similar to FIG. 6, wherein the main body has been further rotated in said clockwise direction to its second position.
Figure 7B:
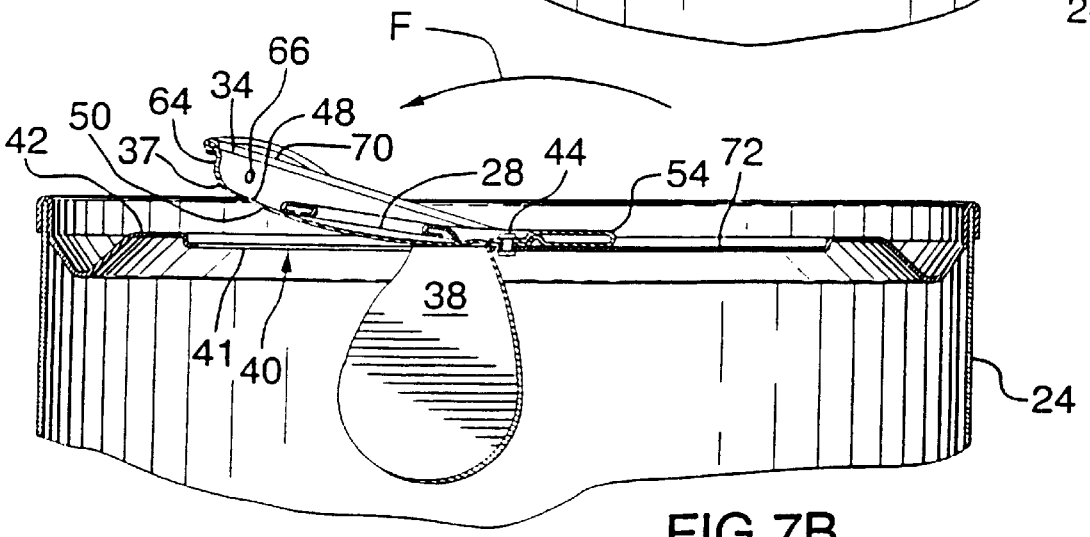
FIG. 7B is a sectional side elevational view of the beverage can portion and ring-pull opener of FIG. 7A.
Figure 8A:
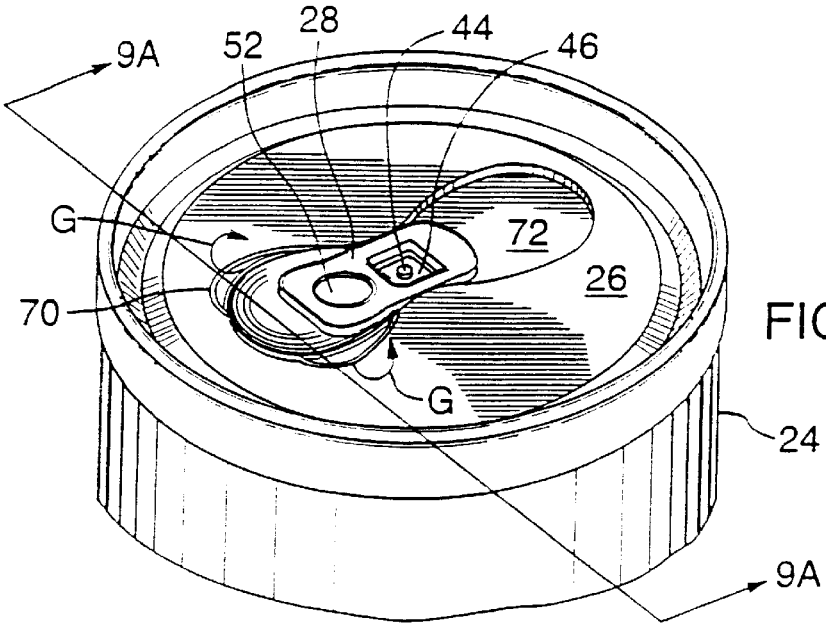
FIG. 8A is a view similar to FIG. 7A, wherein the closure portion has been manipulated downwardly into the can opening to a fully inserted position.
Figure 8B:
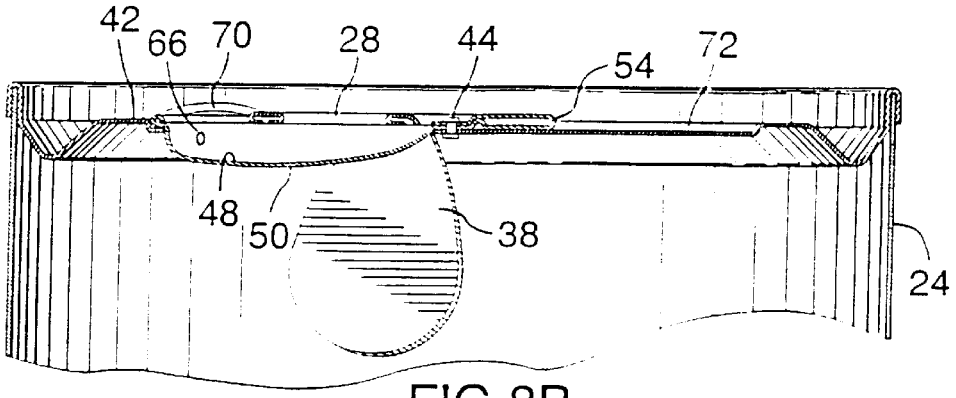
FIG. 8B is a sectional side elevational view of the beverage can portion and ring-pull opener of FIG. 8A.
Figure 8C:
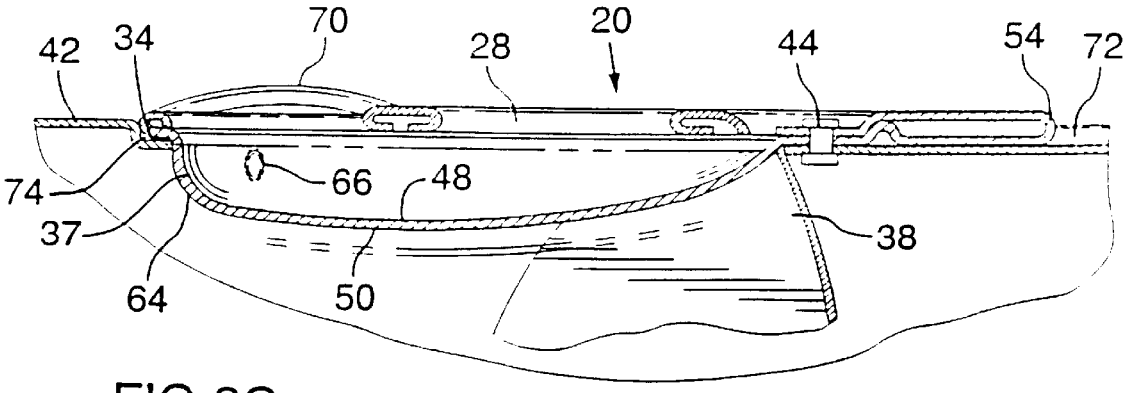
FIG. 8C is an a view similar to FIG. 8B, on an enlarged scale.

Once the second position is obtained (as shown in FIGS. 7A and 7B), the closure portion 32 is moved by the user in the direction of arrow F (as shown in FIG. 7B) so as to cause downwardly directed, hinged movement of the closure portion 32 about the rivet 44 to a fully inserted position below the second operative plane 33, as shown in FIGS. 8A–8C. The peripheral flange portion 34 of the closure portion 32 defines an area slightly greater than that of the opening 40, and for this reason it overlies the perimeter of the opening 40 in overlapping contacting relation with the non-movable region of material 42 when the main body 27 has been moved into the fully inserted position. In this manner, the peripheral flange portion 34 interacts with the perimeter of the opening 40 to form a stop means to prevent the closure portion from passing through the opening 40 into the interior of the can 22. With this arrangement, it will be appreciated that the closure portion 32 will, when positioned in the fully inserted position of FIGS. 8A, 8B and 8C, substantially occlude the opening 40. Moreover, such occlusion, together with the overlying interaction of the peripheral flange portion 34 with the perimeter 68 area around the opening 40 (see FIGS. 9B and 9C), will substantially seal the opening in the top wall 26. In this manner, the original quality of a beverage within the can 22, including carbonation, can be substantially sustained, perhaps with refrigeration, for a considerable number of hours, or even days. Moreover, substantial resistance to spillage is also obtained.

Figure 9A:
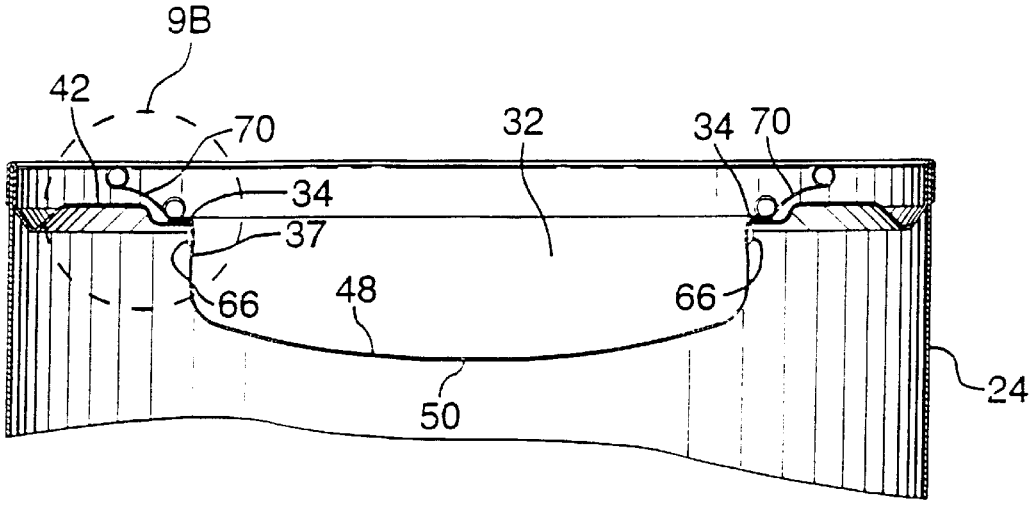
FIG. 9A is a sectional view along line 9A—9A of FIG. 8A.
Figure 9B:
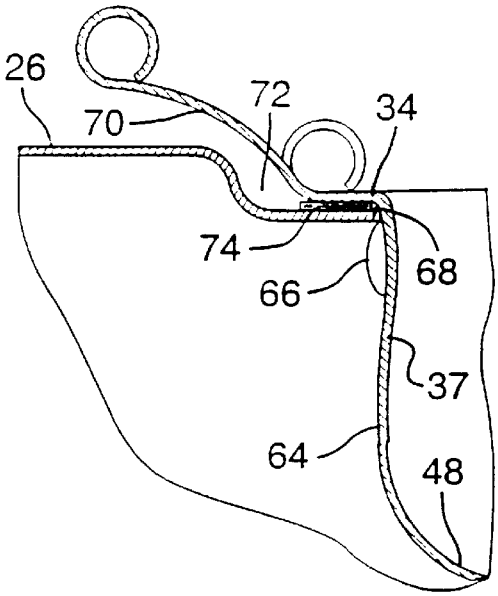
FIG. 9B is an enlarged view of the circled area 9B of FIG. 9A.
Figure 9C:
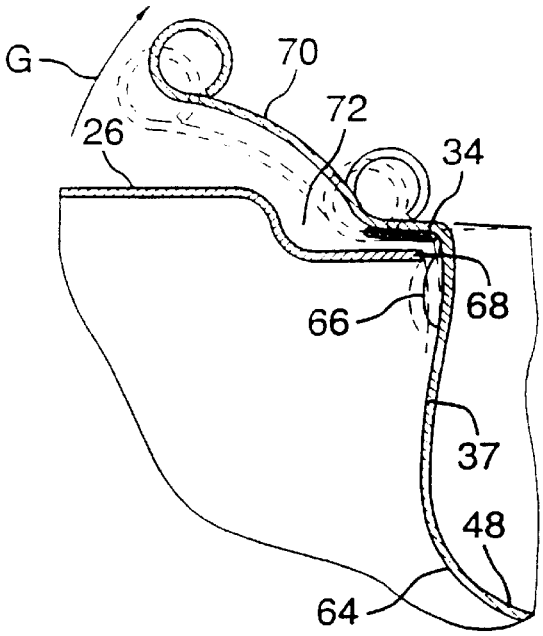
FIG. 9C is a view similar to FIG. 9B.

As can be seen best in FIGS. 9A–9C, the outer (ie., downwardly directed) surface 64 of the skirt portion 37 is preferably provided with two laterally outwarding extending nibs 66, positioned thereon such that, when the skirt portion 37 is in the fully inserted position within the opening 40, the two nibs 66 each underlie the perimeter 68 of the opening 40 in the top wall 26, so as to resist removal of the closure portion 32, including the skirt portion 37, from within the opening 40, due to yielding frictional contact of the nibs 66 with the perimeter edge 68. It is also preferable that all free edges of the main body 27, including that of the circular cut-out 52, be rolled over as shown In the Figures, so that no sharp edges are exposed to cut a user.

In order to assist the user to re-open the beverage can 22 after sealing it with the closure portion 32 (as shown in FIGS. 8A–8C), the peripheral flange portion 34, is also preferably provided, in the region above each of the nibs 66, with an upwardly angled, laterally extending wing member 70. The purpose of the wing members 70 is twofold. In the first instance, the wing members 70 each provide a surface to facilitate gripping by a user when he/she wishes to re-open the can from the fully inserted position of the closure portion 32. Absent the presence of such wing members 70, it would be difficult for the user to grasp the peripheral flange portion 34, which is in sealingly close contact with the non-movable material 42 of the top wall 26 in the proximity of the perimeter 68 of opening 40, to lift the closure portion 32. Fingernails, or other implements might, in fact, be necessary for this purpose, particularly where the preferred nibs 68 are fully engaged, as shown in FIGS. 9A–9C. The upwardly angled, laterally extending wing members 70 are not in close contact with the perimeter 68 of the opening 40, so that they may be easily grasped and lifted between the thumb and first finger of a user. This action, indicated by arrow G of FIGS. 8A and 9C, also causes the wings 70 to be squeezed toward one another, thereby to cause a slight concave contraction of the closure portion 32 about its centreline, which contraction in turn causes the nibs 66 to move inwards from their original position (as shown in solid outline in FIG. 9B and in phantom outline in FIG. 9C) to a squeezed position (shown in solid outline in FIG. 9C). The closure portion can then be upwardly removed from the fully inserted position, to a position equivalent to that shown in FIGS. 7A and 7B, and thereafter rotated 180 degrees for reseating in the recess 72 at its original position (equivalent to that shown in FIGS. 5A and 5B). The process of opening and closing the can be repeated in an analogous manner, as required.

A bead 74 of a conventional sealing compound is preferably disposed at the junction of the underside of the peripheral flange portion 34 and the skirt portion 37, to act as a gasket to assist in the making of a seal between the closure portion 32 and the perimeter of the opening 40 in the top wall 26 of the can 22.

As is visible in most of the Figures, the top wall 26 is preferably provided with a recess 72, to accommodate the closure portion 32 when the ring-pull member 20 is in the first position illustrated in FIGS. 1, 2 and 3B. The provision of a recess 72 allows the closure portion 32 to lie lower with respect to the top wall 26 to facilitate stacking of cans 22 on top of one another. The recess 72 preferably extends around the perimeter 68 of the opening 40 in a conventional manner to effectively form an embossed collar around the opening 40, thereby ensuring a substantially flat, even flat surface of close tolerances around the opening 40 for critical sealing interaction with the peripheral flange portion 34, as previously disclosed.

It will be appreciated that the opening 40 defined by the score-line 36 need not have the specific shape illustrated in the drawings. A wide variety of other shapes and sizes could be used instead, as required. The prime consideration is that the closure portion 32 of the main body should have an overall size and shape slightly greater than that of the opening 40, the skirt portion 37 should have the same general size and shape as the opening 40 so as to provide for a close fit of the closure portion 32 within the opening 40 in sealing, but non-jamming relation therein, and the grippable ring portion 28 should have a size sufficient to enable it easily to be manipulated to open the can 22 in the first instance.

The connecting nose portion 54 and/or the upper 48 and lower 50 surfaces of the closure portion 32 may be reinforced, for example by the provision of ribs (not shown), to ensure they has sufficient strength to sheer the movable region of material 38 away from the non-movable part 42 of the top wall 26.

It will be understood that numerous variations as will occur to those skilled in the art may be made to the above-described apparatus without departing from the claimed scope of the invention. For example, in an alternative embodiment, it is further contemplated that the mounting means, the rivet 44 in the preferred embodiment, is positioned on the top wall 26 of the can 22 in the movable region of material 38, such that the movable region of material 38 is removable from said top wall 26.

Various other embodiments of the present invention also fall within the spirit and scope of the present invention, which is limited only by the claims presented herewith.

We claim:

1. A selectively reclosable ring-pull opener (20) for use with a can (22) of the type having a top wall (26), a base wall (25), and a cylindrical side wall (24) joining said top and base walls (26), (25) together in sealed relation, with a score line (36) in said top wall (26) defining a movable region of material (38) movable between a first closed position, whereat said movable region of material (38) is integral with said top wall (26) in sealing relation therewith, and an open position whereat said movable region of material (38) is displaced from said first closed position, so as to create and opening in said top wall (40), said movable region of material being bounded by a non-movable region of material (42), said ring-pull opener (20) characterized by:

a unitary main body (27) comprising:

a manually grippable ring portion (28) extending above said top wall (26) in acutely angled relation to said top wall (26) to define a first operative plane relative to said top wall (26);

a closure portion (32) underlying said manually grippable ring portion (28) and extending above said top wall (26) in substantially parallel overlying relation to said top wall (26) to define a second operative plane substantially parallel to said top wall (26), said closure portion (32) having a peripheral flange portion (34) and a downwardly depending skirt portion (37) of substantially the same plan outline and size as said opening (40), said closure portion (32) being solid at least within the area bounded by the skirt portion (37);

a tab portion (46) extending downwardly from said ring portion (28) to contact, in overlying relation, an upper surface of said closure portion (48); and, a connecting nose portion (54) extending in folded connecting relation from a peripheral edge of said ring portion (56) to an underlying peripheral edge of said closure portion (58);

a mounting means adapted to be (44) affixed to the top wall (26) and operatively passing through said tab portion (46) and said upper surface of said closure portion (48) to movably mount said main body (27) on the top wall (26) of the can for upwardly directed, hinging movement of said manually grippable ring portion (28) from said first operative plane toward the vertical, for coincident downward movement of said connecting nose portion (54) into opening urging contact with said movable region of material (38), thereby to cause movement of said movable region (38) from said first closed position to said open position, for rotatable movement of said main body (27) in said second operative plane from a first position whereat said skirt portion (37) is removed from overlying the perimeter of said opening (40), and a second position whereat said skirt portion (37) is in overlying registered relation with said opening (40), and for downwardly directed, hinged movement of said closure portion (32) below said second operative plane;

said peripheral flange portion (34) being shaped and dimensioned to overlie the perimeter of said opening (40) in overlapping contacting relation to said non-movable region (42) of material when said movable region (38) of material has been moved to said open position as aforesaid, said main body (27) has been rotatably moved to said second position, and said closure portion (32) has been hingingly moved as aforesaid below said second operative plane to a fully inserted position;

at which fully inserted position said closure portion (32) substantially occludes said opening (40);

wherein the outer surface of said downwardly extending skirt portion (37) is provided with one or more laterally outwardly extending nibs (66), such that, when said skirt portion (37) is, in said fully inserted position, within the opening (40), said nibs (66) underlie the top wall (26) and resist removal of the skirt portion (37) from within the opening (40) by way of yielding frictional contact with said top wall (37) upon such removal; and wherein a bead (74) of sealing material is provided at the area of the junction between said skirt portion (37) and the peripheral flange portion (34), to enhance said sealing between said peripheral flange portion (34), said skirt portion (37) and said opening (40).

2. The ring-pull opener (20) of claim 1, wherein said mounting means is a rivet (44).

3. The ring-pull opener (20) of claim 2, wherein the region of the closure portion (32) interiorly of the skirt portion (37) is an embossment disposed at the lowermost extent of said skirt portion (37).

4. The ring-pull opener (20) of claim 3, wherein the depth of said embossment is tapered, with the deepest section positoned furtherest from said rivet (44), and the shallowest section is positioned adjacent to said rivet (44).

* * * * *